United States Patent [19]

von Dreusche, Jr.

[11] 4,078,503

[45] Mar. 14, 1978

[54] METHOD AND APPARATUS FOR TREATING OFF-GAS FROM A FURNACE FOR BURNING ORGANIC MATERIAL IN AN OXYGEN DEFICIENT ATMOSPHERE

[75] Inventor: Charles F. von Dreusche, Jr., Ramsey, N.J.

[73] Assignee: Nichols Engineering & Research Corporation, Belle Mead, N.J.

[21] Appl. No.: 706,613

[22] Filed: Jul. 19, 1976

[51] Int. Cl.[2] ..... F23G 7/06; F23J 15/00

[52] U.S. Cl. ..... 110/208; 110/119; 55/84; 55/267; 23/277 C; 110/214; 110/216; 110/345; 110/346

[58] Field of Search ..... 110/8 A, 119; 23/277 C; 55/94, 84, 135, 267

[56] References Cited

U.S. PATENT DOCUMENTS

| | | | |
|---|---|---|---|
| 3,668,833 | 6/1972 | Cahill, Jr. | 110/119 |
| 3,704,570 | 12/1972 | Gardenier | 23/277 C |
| 3,794,565 | 2/1974 | Bielski et al. | 110/119 |
| 3,808,619 | 5/1974 | Vanderveer | 110/119 |
| 3,812,793 | 5/1974 | Soloman | 110/8 |
| 3,820,510 | 6/1974 | Vayssiere | 110/119 |

*Primary Examiner*—Kenneth W. Sprague
*Attorney, Agent, or Firm*—Edwin T. Grimes

[57] ABSTRACT

A method and apparatus for treating off-gas from a furnace for burning organic material in an oxygen deficient atmosphere by passing the hot exhaust gases from the furnace ladened with combustible and noncombustible organic material to a cleaning device, and thence passing the gases to a secondary furnace for combustion therein, and while in the cleaning device removing from the gas therein noncombustible material which would otherwise still be particulate matter in the exhaust from the secondary furnace. In another form of the invention, the exhaust gas from the furnace is passed to a burner and heat exhanger device having an inlet portion for heating the incoming gases, a combustion portion with air inlets for supporting combustion therein, and an outlet portion for cooling the gases, and thereafter the gases are passed to a quenching system.

13 Claims, 2 Drawing Figures

METHOD AND APPARATUS FOR TREATING OFF-GAS FROM A FURNACE FOR BURNING ORGANIC MATERIAL IN AN OXYGEN DEFICIENT ATMOSPHERE

BACKGROUND OF THE INVENTION

This invention relates to method and apparatus for treating off-gas from a furnace for burning organic material in an oxygen deficient atmosphere. The invention is particularly adapted, among other possible uses, for use in treating the exhaust gases from burning municipal, industrial or community garbage, trash or refuse, and sewage sludge, for example.

The problem of preventing air pollution in our present environment has become a critical matter. The seriousness of this problem is such that the National Air Pollution Control Administration Air Criteria (U.S. Public Health) as well as the Environmental Protection Agency, have constantly been tightening the mimimum required standards. In view of the new and higher standards of air emission, it has become more difficult and expensive to treat the exhaust gases from such incineration. I have substantially reduced this problem in a new and improved manner, as will become apparent as the description proceeds.

SUMMARY OF THE INVENTION

In order to accomplish the desired results, the invention provides, in one form thereof, a new and improved method of treating off-gas from a furnace for burning organic material in an oxygen deficient atmosphere, which includes the steps of passing hot exhaust gases from the furnace that are ladened with combustible and noncombustible organic material to a cleaning device, and thereafter passing the gases to a secondary furnace for combustion therein. In the cleaning device there is removed from the exhaust gas, the noncombustible material which would otherwise still be particulate matter in the exhaust of the secondary furnace. According to one aspect of the invention, the exhaust gases are maintained at substantially constant temperature in the cleaning device during the step of removing the noncombustible matter which would otherwise still be particulate matter in the exhaust from the secondary furnace, and according to another aspect thereof heat is added to the gases entering the cleaning device so as to maintain the temperature therein at about 1200° F.

In another form of the invention, I provide a new and improved method and apparatus for treating the off-gas from a furnace for burning organic material in an oxygen deficient atmosphere by means of the provision of a burner and heat exchanger device having an inlet portion, an outlet portion and a combustion portion, whereby the exhaust gases from the furnace pass to the inlet portion wherein they are heated and thence passed to the combustion portion where air is added to support combustion, and thence they are passed to the outlet portion for cooling. Thereafter, the gases are quenched in a quencher system by passing a cooling fluid therethrough. According to an aspect of the invention, the gases from the quenching system are thence passed to a secondary furnace, and according to still another aspect water and/or steam is added to the gases in the combustion portion of the burner and heat exchanger device. In one form of the invention, the inlet portion, the outlet portion and the combustion portion of the burner and heat exchanger device comprise an inner tubular member for receiving the exhaust gases from the furnace at one end thereof, an outer tubular member encompassing the inner member. The outlet and the inlet are at the same end of the device, and the combustion portion is disposed at the opposite end thereof. Thus, the gases passing through the inlet portion are heated by the gases passing through the outlet portion. In one embodiment, the entering gases are at a temperature of from about 400° F., to about 1000° F. and are heated in the inlet portion, and thence the gases are heated to a temperature in the range of from about 1200° F. to about 2000° F. in the combustion portion, and thereafter they are cooled in the outlet portion to a temperature in the range of from about 400° F. to about 1000° F.

There has thus been outlined rather broadly the more important features of the invention in order that the detailed description thereof that follows may be better understood, and in order that the present contribution to the art may be better appreciated. There are, of course, additional features of the invention that will be described hereinafter and which will form the subject of the claims appended hereto. Those skilled in the art will appreciate that the conception upon which the disclosure is based may readily be utilized as a basis for the designing of other methods and apparatus for carrying out the several purposes of the invention. It is important, therefore, that the claims be regarded as including such equivalent methods and apparatus as do not depart from the spirit and scope of the invention.

Specific embodiments of the invention have been chosen for purposes of illustration and description, and are shown in the accompanying drawings, forming a part of the specification.

DETAILED DESCRIPTION OF THE PREFERRED EMBODIMENTS

Heretofore, in order to support combustion, excess air was added at the bottom of the furnace. Problems were encountered due to the fact that the middle portions of the furnace tended to overheat beyond the structural design limits of the furnace, and in order to overcome this problem, it was thought necessary to add more air or oxygen at the bottom of the furnace. Thus, such a system frequently operated with as much as 100% excess air (above that required for supporting combustion) being added at the bottom of the furnace in order to cool the central portion thereof to workable limits. However, such excess air tended to entrain or carry with it particulate matter into the exhaust gases, which compounded the problem of treating such gases. In copending application filed on the same date as the present application and entitled "Method and Apparatus for Incinerating Waste Material" there is disclosed a new and improved system wherein the air supply is controlled so that in most portions of the furnace there is a deficiency of oxygen, as compared to that theoretically required for complete combustion. This substantially reduces the problem, but there is still a need for treating the exhaust gases.

Figure 1:
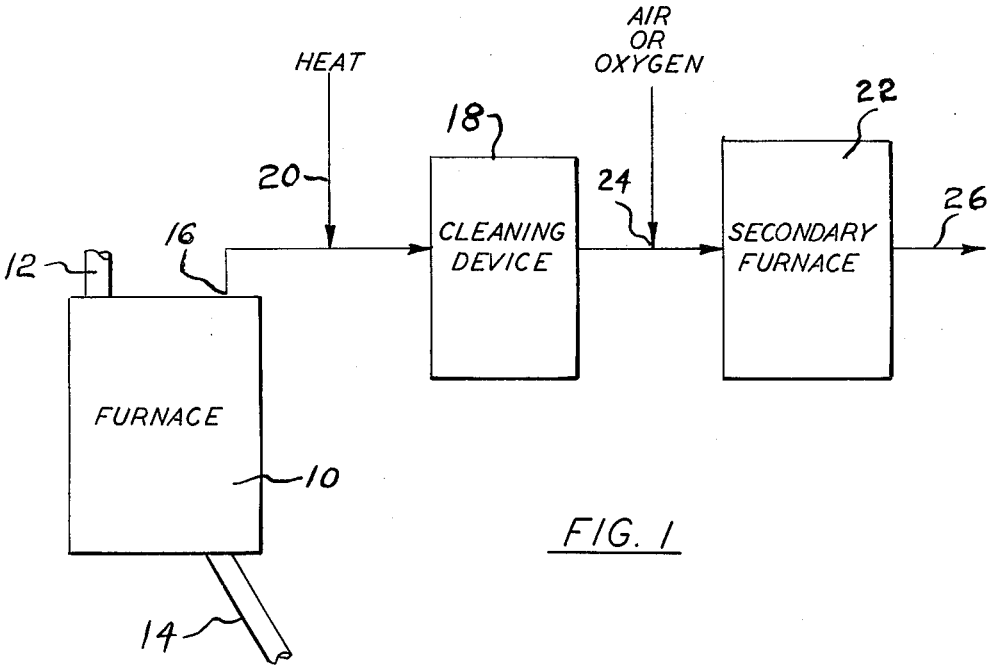
FIG. 1 is a diagrammatic illustration of a system for treating off-gas from a furnace burning organic material in an oxygen deficient atmosphere, according to one embodiment of the invention.

In the embodiment of FIG. 1, there is illustrated a furnace 10 having an upper waste material inlet 12, a lower solids outlet 14 and an upper exhaust gas outlet 16. This furnace may be of any suitable type such as a multiple hearth, rotary shaft kiln, or the like, for example. It may be directly or indirectly fired. However, the burning therein is effected in an oxygen deficient atmosphere with respect to that required for theoretically complete combustion. Consequently, the exhaust gases appearing at the exhaust gas outlet 16 are hot and are ladened with combustible and noncombustible organic material. That is, these gases may contain particulate matter, hydrocarbons, corbonyles, stable organic aerosols (including tar fog or blue haze) as well as various gases, and the like. It will be appreciated that this exhaust gas may contain substantial heat value, which according to the present invention, is converted into useful form.

As seen in FIG. 1, the exhaust gases from the furnace 10 are passed to a cleaning device 18 and heat may be added thereto, as at 20, prior to the cleaning device. Thereafter, the socleaned exhaust gases are passed to a secondary furnace or burning device 22 after air or oxygen has been added thereto, as indicated at 24, so that the discharge 26 from the secondary furnace is relatively clean.

The cleaning device 18 may be of any suitable type, which removes from the exhaust gases the noncombustibles which would otherwise still be particulate matter in the exhaust after the combustion step in the secondary furnace 22. Preferably according to the invention, the cleaning device 18 cleans the exhaust gases without cooling them and for such purposes the type of cleaning device may include a hot cyclone, electrostatic precipitator or a hot mechanical filter (stone or metal), for example. More preferably, the cleaning device 18 is of such a nature that it does not catch or collect combustible particles such as the tar fog. This is effected by adding heat, as indicated at 20, so as to maintain the temperature in the cleaning device 18 above about 1200° F. so that the tar fog becomes vapor and passes through to the second furnace 22. It will be appreciated that if the temperature in the cleaning device 18 falls below about 1200° F. the carbon dioxide will crack according to the reaction $2CO \rightarrow C + CO_2$, which produces fixed carbon, i.e., carbon black and the like that creates a soot problem.

Thus, it will be seen that if the off-gas from the furnace 10 is cleaned in the manner described above the sensible heat contained therein may readily be employed for useful purposes in the secondary furnace or heating device 22.

Figure 2:
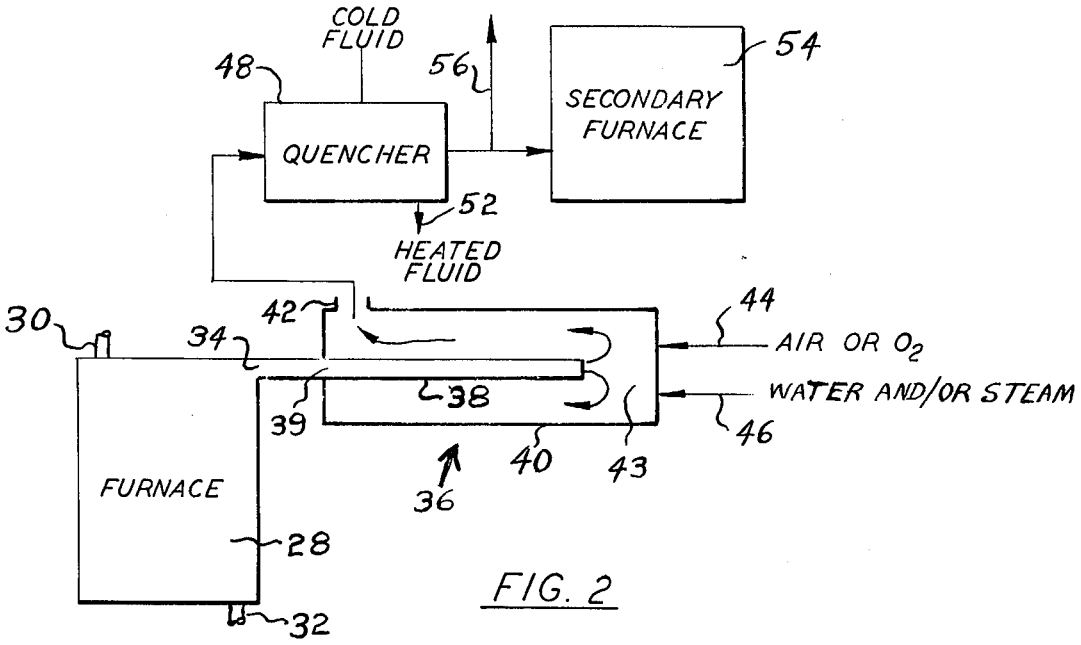
FIG. 2 is a diagrammatic illustration of a system similar to FIG. 1, but showing another embodiment of the invention.

In the embodiment of the invention illustrated in FIG. 2, a furnace 28 is provided, which may be of the same type as that described hereinbefore in connection with the furnace 10 of FIG. 1. Thus, the furnace 28 has an upper waste material inlet 30, a lower solids outlet 32 and an upper exhaust outlet 34. The exhaust gases from the outlet 34 thence pass to a burner and heat exchanger device 36, having an inner tubular member 38 for receiving the gases through an inlet 39 and an outer tubular member 40 encompassing the inner member. An outlet 42 is provided in the outer tubular member at the same end of the device as where the inlet 39 is located. At the opposite end of the device, as indicated at 43, air or oxygen is added, as at 44, and water and/or steam may also be added, if necessary, as at 46. In operation, the exhaust gases enter the device through the inlet 39 at a temperature of from about 400° F. to about 1000° F. and are heated in the inner tube 38. When these so-heated gases reach the area of the device indicated at 43, air or oxygen is added and water and/or steam is also added, if necessary, whereby combustion occurs and the gases are heated to a temperature in the range of from about 1200° F. to about 2000° F. The tar fog and carbon convert to material, which will be noncondensible at standard pressure and temperature conditions. Thereafter, the gases pass back through the outer tube 40 wherein their temperature gradually drops to a temperature in the range of from about 400° F. to about 1000° F. by means of giving up heat to the incoming exhaust gas. These gases leave the burner and heat exhanger device through the outlet 42 and are passed to a quencher system 48. The quencher 48 receives a cold fluid as at 50 which is heated therein before it is discharged as a heated fluid, as at 52. In operation, the gases enter the quencher system 48 where they are rapidly quenched. In some installations, this system may also include cleaning means or other cold gas cleaning devices. The output from the quencher is passed to a secondary furnace 54 or to a pipe line 56 for further processing. The heated fluid discharged from the quencher system at 52 is profitably employed in a heat exchanger such as for preheating boiler feed water, preheating combustion air or preheating the waste material fed to the furnace 28, for example. Also, as another example, the heated fluid per se could be used as combustion air.

Having thus described the invention with particular reference to the preferred forms thereof, it will be obvious to those skilled in the art to which the invention pertains, after understanding the invention that various changes and modifications may be made therein without departing from the spirit and scope of the invention, as defined by the claims appended hereto.

What is claimed is:

1. A method of treating off-gas from a furnace for burning organic material in an oxygen deficient atmosphere comprising the steps of continuously passing hot exhaust gases from said furnace ladened with combustible and noncombustible organic material to a cleaning device, and thence passing the gases to a secondary furnace for combustion therein, removing in said cleaning device said exhaust gas therein noncombustible material which would otherwise still be particulate matter in the exhaust of said secondary furnace, said exhaust gases being maintained at an elevated temperature in the cleaning device during said step of removing the noncombustible matter which would otherwise still be particulate matter in the exhaust of said secondary furnace.

2. A method of treating off-gas from a furnace for burning organic material in an oxygen deficient atmosphere comprising the steps of continuously passing hot exhaust gases from said furnace ladened with combustible and noncombustible organic material to a cleaning device, and thence passing the gases to a secondary furnace for combustion therein, removing in said cleaning device said exhaust gas therein noncombustibel material which would otherwise still be particulate matter in the exhaust of said secondary furnace, and heat being added to said gases entering said cleaning device to maintain a temperature in the cleaning device of the order of about 1200° F.

3. Apparatus for treating off-gas from a furnace for burning organic material in an oxygen deficient atmosphere comprising, in combination, means for passing hot exhaust gases ladened with combustible and noncombustible organic material to a cleaning device, a secondary furnace, means for passing the gases discharged from said cleaning device to said secondary furnace, and means for removing in said cleaning device from said exhaust gas therein noncombustible material which would otherwise still be particulate matter in the exhaust of said secondary furnace, and means for maintaining said exhaust gases in said cleaning device at an elevated temperature.

4. Apparatus for treating off-gas from a furnace for burning organic material in an oxygen deficient atmosphere comprising, in combination, means for passing hot exhaust gases ladened with combustion and noncombustible organic material to a cleaning device, a secondary furnace, means for passing the gases discharged from said cleaning device to said secondary furnace, and means for removing in said cleaning device from said exhaust gas therein noncombustible material which would otherwise still be particulate matter in the exhaust of said secondary furnace, and means for adding heat to said gases entering said cleaning device to maintain a temperature in the cleaning device of the order to about 1200° F.

5. A method of treating off-gas from a furnace for burning organic material in an oxygen deficient atmosphere comprising the steps of passing exhaust gases from said furnace to a burner and heat exchanger device having an inlet portion and an outlet portion and a combustion portion, heating said gases in the inlet portion, adding air to the gases to support combustion in the combustion portion and cooling said gas in the outlet portion, and thence passing said gases to a quencher system, quenching said gases in the quencher system by passing cooling fluid therethrough.

6. A method of treating off-gas from a furnace for burning organic material in an oxygen deficient atmosphere according to claim 5 wherein said gases are passed from said quenching system to a secondary furnace.

7. A method of treating off-gas from a furnace for burning organic material in an oxygen deficient atmosphere according to claim 5 wherein the gases in said outlet portion of said burner and heat exchanger device heat the gases in said inlet portion thereof.

8. A method of treating off-gas from a furnace for burning organic material in an oxygen deficient atmosphere according to claim 5 wherein water or steam is added to said gases in said combustion portion of said burner and heat exchanger device.

9. A method of treating off-gas from a furnace for burning organic material in an oxygen deficient atmosphere according to claim 7 wherein the gases entering said inlet portion of said burner and heat exchanger device are at a temperature in the range of from about 400° F. to about 1000° F. and wherein the gases in said combustion portion are heated to a temperature in the range of from about 1600° F. to about 2000° F., and wherein the gases in said outlet portion are cooled to a temperature in the range of from about 400° F. to 1000° F.

10. Apparatus for treating off-gas from a furnace for burning organic material in an oxygen deficient atmosphere comprising, in combination, a burner and heat exchanger device having an inlet portion, an outlet portion and a combustion portion, means for passing exhaust gases from the furnace to said inlet portion, means for adding air to said combustion portion, quenching system, and means for passing gases from said outlet portion to said quenching system, and a secondary furnace operatively coupled to said quenching system.

11. Apparatus for treating off-gas from a furnace for burning organic material in an oxygen deficient atmosphere comprising, in combination, a burner and heat exchanger device having an inlet portion, an outlet portion and a combustion portion, means for passing exhaust gases from the furnace to said inlet portion, means for adding air to said combustion portion, a quenching system, and means for passing gases from said outlet portion to said quenching system, said outlet portion of said burner and heat exchanger device being disposed in heat exchange relationship with respect to said inlet portion thereof.

12. Apparatus for treating off-gas from a furnace for burning organic material in an oxygen deficient atmosphere comprising, in combination, a burner and heat exchanger device having an inlet portion, an outlet portion and a combustion portion, means for passing exhaust gases from the furnace to said inlet portion, means for adding air to said combustion portion, a quenching system, and means for passing gases from said outlet portion to said quenching system, and means for adding water or steam to said combustion portion of said burner and heat exchanger device.

13. Apparatus for treating off-gas from a furnace for burning organic material in an oxygen deficient atmosphere comprising, in combination, a burner and heat exchanger device having an inlet portion, an outlet portion and a combustion portion, means for passing exhaust gases from the furnace to said inlet portion, means for adding air to said combustion portion, a quenching system, and means for passing gases from said outlet portion to said quenching system, said inlet portion, said outlet portion and said combustion portion of the burner and heat exchanger device comprising an inner tubular member for receiving the exhaust gases from the furnace at one end thereof, an outer tubular member encompassing said inner member, said outer member having an outlet at the same end as said one end of said inner member, and said combustion portion being disposed at the opposite end of said tubular members.

* * * * *